US012025329B2

(12) United States Patent
Haessig et al.

(10) Patent No.: US 12,025,329 B2
(45) Date of Patent: Jul. 2, 2024

(54) HVAC MOTOR CONTROL LOCAL DISPLAY AND ADJUSTMENT METHODS AND APPARATUS FOR SAME

(71) Applicant: Evolution Controls Inc., Poway, CA (US)

(72) Inventors: David Lee Haessig, Poway, CA (US); Ronald Sai Kit Yip, Poway, CA (US); Roger Hort, Poway, CA (US); Joshua Lee Welton, Poway, CA (US)

(73) Assignee: Evolution Controls Inc., Poway, CA (US)

( * ) Notice: Subject to any disclaimer, the term of this patent is extended or adjusted under 35 U.S.C. 154(b) by 0 days.

(21) Appl. No.: 17/541,706

(22) Filed: Dec. 3, 2021

(65) Prior Publication Data

US 2022/0186964 A1 Jun. 16, 2022

Related U.S. Application Data

(60) Provisional application No. 63/123,765, filed on Dec. 10, 2020.

(51) Int. Cl.
*F24F 11/52* (2018.01)
*F24F 11/56* (2018.01)

(52) U.S. Cl.
CPC ..... *F24F 11/52* (2018.01); *F24F 11/56* (2018.01)

(58) Field of Classification Search
CPC ..... F24F 11/52; F24F 11/523; F24F 11/56
See application file for complete search history.

(56) References Cited

U.S. PATENT DOCUMENTS 8,554,376 B1 * 10/2013 Matsuoka ..... F24F 11/523 236/46 R
9,920,944 B2 * 3/2018 Chromy ..... F24F 11/52
2009/0158188 A1 * 6/2009 Bray ..... F24F 11/52 700/83
2012/0246590 A1 * 9/2012 D'Souza ..... G05D 23/1902 715/771

(Continued)

OTHER PUBLICATIONS

Evolutions Controls Inc., Visual Control Unit EC Motor, Series 2, Mar. 13, 2018, http://www.gotoevo.com/, San Diego, California, USA.

(Continued)

*Primary Examiner* — Jonathan Bradford
(74) *Attorney, Agent, or Firm* — Weintraub Tobin; Jo Carothers

(57) ABSTRACT

A method and apparatus for a visual local controller (VLC) for a variable speed motor (VS Motor) or other controlled device in an HVACR system to display the output in engineering units instead of the traditional percent of motor output or similar output, and to limit the output to a range between a high limit and a low limit, is disclosed. An engineering units display allows end users to directly see output as performed by the connected HVACR equipment. In place of zero to one-hundred percent output, the user may see torque, CFM, actual control voltage or other engineering units associated with the controlled HVACR equipment. Limiting the output allows the output to be constrained between high and low output limits to keep the connected device operating within a safe range for the HVACR equipment.

39 Claims, 4 Drawing Sheets

(56) References Cited

U.S. PATENT DOCUMENTS

2019/0368763 A1* 12/2019 Noor ..... G06F 3/011

OTHER PUBLICATIONS

ICM Controls, ICM708 GE 2.3 ECM Controller, www.icmcontrols.com, USA.
RTC Solutions, EC Motor Control FSC-1, www.RTC-Solutions.com, Davie, Florida, USA.
Price Industries, ECM-DX Price Deluxe ECM Speed Controller, www.priceindustries.com/contact/product-support.
Hoffman Controls, 763-ECM EC Motor Variable Speed Control, Sep. 24, 2019, www.hoffmancontrols.com.
Nidec Motor Corporation, Rescue PerfectSpeed ECM with User Interface For enhanced capabilities, Sep. 2019, 19-8542-01 Rev. 09/19, Nidec Motor Corporation.

* cited by examiner

VLC Digital Adjustment Profile 3000

Registers

| | | |
|---|---|---|
| 3010 | Min Display Value | Displayed value when output = 0% |
| 3020 | Max Display Value | Displayed value when output = 100% |
| 3030 | Decimal Position | Number = decimal position, 0 = no decimal |
| 3040 | Pulses Per Turn | Pulses per turn from the connected motor |
| 3050 | High Out Limit | Maximum percent allowed from the output |
| 3060 | Low Out Limit | Minimum percent allowed from the output |

*FIG. 3*

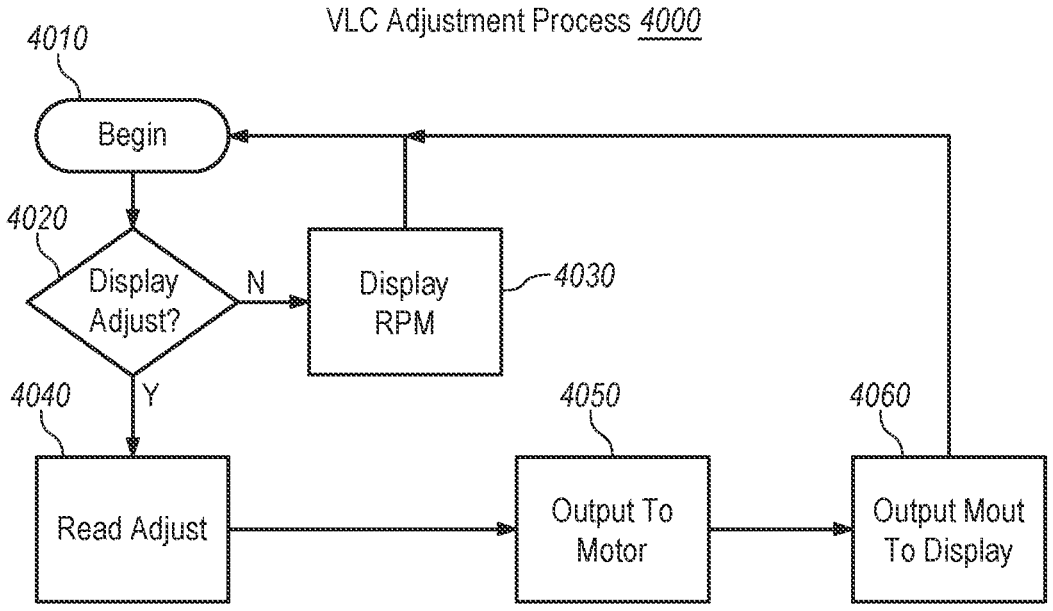

*FIG. 4*

*(PRIOR ART)*

HVAC MOTOR CONTROL LOCAL DISPLAY AND ADJUSTMENT METHODS AND APPARATUS FOR SAME

CROSS-REFERENCE TO RELATED APPLICATIONS

This application claims priority under 35 U.S.C. Section 119(e) to co-pending U.S. Provisional Patent Application No. 63/123,765, filed on Dec. 10, 2020, the entire disclosure of which is incorporated herein by reference.

FIELD OF THE INVENTION

The present invention relates generally to local display and adjustment devices for motors and other components in heating, ventilating, air-conditioning, and refrigeration ("HVACR") systems.

BACKGROUND OF THE INVENTION

HVACR machines are often fitted with one or more variable output, or variable speed motors ("VS Motors") where the output is controlled in proportion to a control signal supplied by a local controller, interface, or automation system. Motor outputs may be controlled in terms of speed, torque, or mass air flow. The speed output by a motor is commonly expressed as revolutions per minute ("RPM"). Torque is commonly expressed as ounce-feet ("oz-ft.") or gram-centimeters ("g-cm"). Mass airflow is commonly expressed as pounds per minute ("lbs./min") or grams per second ("g/sec"), but one of skill in the art commonly simplifies the expression to cubic feet per minute ("CFM") or cubic meters per second ("CMS").

VS Motors often have a visual local control ("VLC"). The existing VLCs have some form of adjustment, such as a rotating knob, increase-decrease buttons, or other similar form of adjustment. The existing VLCs also have some form of display to indicate the adjustment setting and the RPMs for the motor. The VLC outputs a voltage proportional signal, pulse width modulated signal, pulse position modulated signal, or digital signal to set the motor speed. The VS Motor returns a proportional signal, pulse rate signal, or other pulse signal that represents the RPMs for the motor.

Adjusting proportionately changes the control signal output by the VLC to set the VS Motor to a value between zero-percent (0%) and one-hundred percent (100%) of its maximum potential output. While an adjustment is being made, the display shows the adjusted output, allowing the operator to see the output value as it is updated. When the operator stops adjusting, the display shows the RPMs of the motor, then alternately shows the adjusted motor output percent relative to one-hundred percent of the maximum potential output value.

While the motor may be adjusted to a constant speed, constant torque, constant CFM or other output parameter, current technology displays the output as zero-percent (0%) to one-hundred percent (100%), one-percent (1%) to one-hundred percent (100%), Off to one-hundred percent (100%), or similar representation of the percentage output relative to one-hundred percent of the maximum potential output value. The operator must translate this adjustment parameter to the actual motor output in engineering units using charts or instruments.

Therefore, it is desirable to have the actual numerical value of the work being done displayed in engineering units. For example, a 50% output may produce 300 cubic feet per minute of air, but the user sees 50% on the display. Instead, it is desired to actually see 300 CFM on the display.

BRIEF SUMMARY OF THE INVENTION

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein According to various embodiments, the invention disclosed herein uses a digital device to load a digital adjustment profile ("DAP") into the VLC.

The disclosed invention provides a mechanism and technique to set values and flags in the VLC that support unique features, including Output Display Scaling, RPM Pulse Count Selection, and Output Limits.

In one embodiment, using the disclosed invention, equipment manufacturers can develop DAPs to customize the VLC to their unique product needs.

In one embodiment, the Output Display Scaling which is the desired display value when the signal is at zero percent (0%), the desired displayed value when the signal is at one-hundred percent (100%), and the position of the display decimal point, are defined in the DAP and then loaded into the VLC. The VLC scales the displays in the range from the zero percent (0%) to the one-hundred percent (100%). In one embodiment, a decimal point position may be defined in the DAP to place the decimal point between any digit in the display. In another embodiment, the decimal point position may be calculated by a microcontroller using floating point processing. With floating point processing, the decimal position is determined by the math package. Engineering units for the output value may be displayed by fixing a label or adding alpha numeric digits to the display. In other embodiments, other math calculations can be used to convert to the desired scaling. For example, the desired value for 0% and 100% could define any two points.

In another embodiment, RPM Pulse Count Selection is provided by defining the number of connected motor RPM pulses per a single turn of the connected motor output by the connected motor in the DAP and then loading the number it into the VLC. The VLC allows a connected motor having any number of pulses per turn to display the proper RPM.

In another embodiment, the Output Limits are provided by defining the minimum allowed output ("Low Limit") and maximum allowed output ("high Limit") in the DAP and then loading them into the VLC. When outputting the signal, the existing VLC outputs the signal from zero-percent (0%) to one-hundred percent (100%). The VLC outputs a signal no lower than the minimum allowed output and no greater than the maximum allowed output.

Other objects, features, and advantages of the present invention will become apparent upon consideration of the following detailed description and the accompanying drawings.

BRIEF DESCRIPTION OF THE DRAWINGS

FIG. 3 is a table of an example Scaling VLC digital adjustment profile.

FIG. 4 illustrates a flow diagram for the prior art VLC digital adjustment.

DETAILED DESCRIPTION OF THE INVENTION

The following is a detailed description of embodiments to illustrate the principles of the invention. The embodiments are provided to illustrate aspects of the invention, but the invention is not limited to any embodiment. The scope of the invention encompasses numerous alternatives, modifications, and equivalents. Reasonable variation and modification are possible within the scope of the forgoing disclosure and drawings without departing from the spirit of the invention. The scope of the invention is limited only by the claims.

While numerous specific details are set forth in the following description to provide a thorough understanding of the invention, the invention may be practiced according to the claims without some or all of these specific details.

Various embodiments will be described in detail with reference to the accompanying drawings. Wherever possible, the same reference numbers are used throughout the drawings to refer to the same or like parts. References made to particular examples and implementations are for illustrative purposes and are not intended to limit the scope of the claims.

Prior Art VLC Diagram 1000

Figure 1:
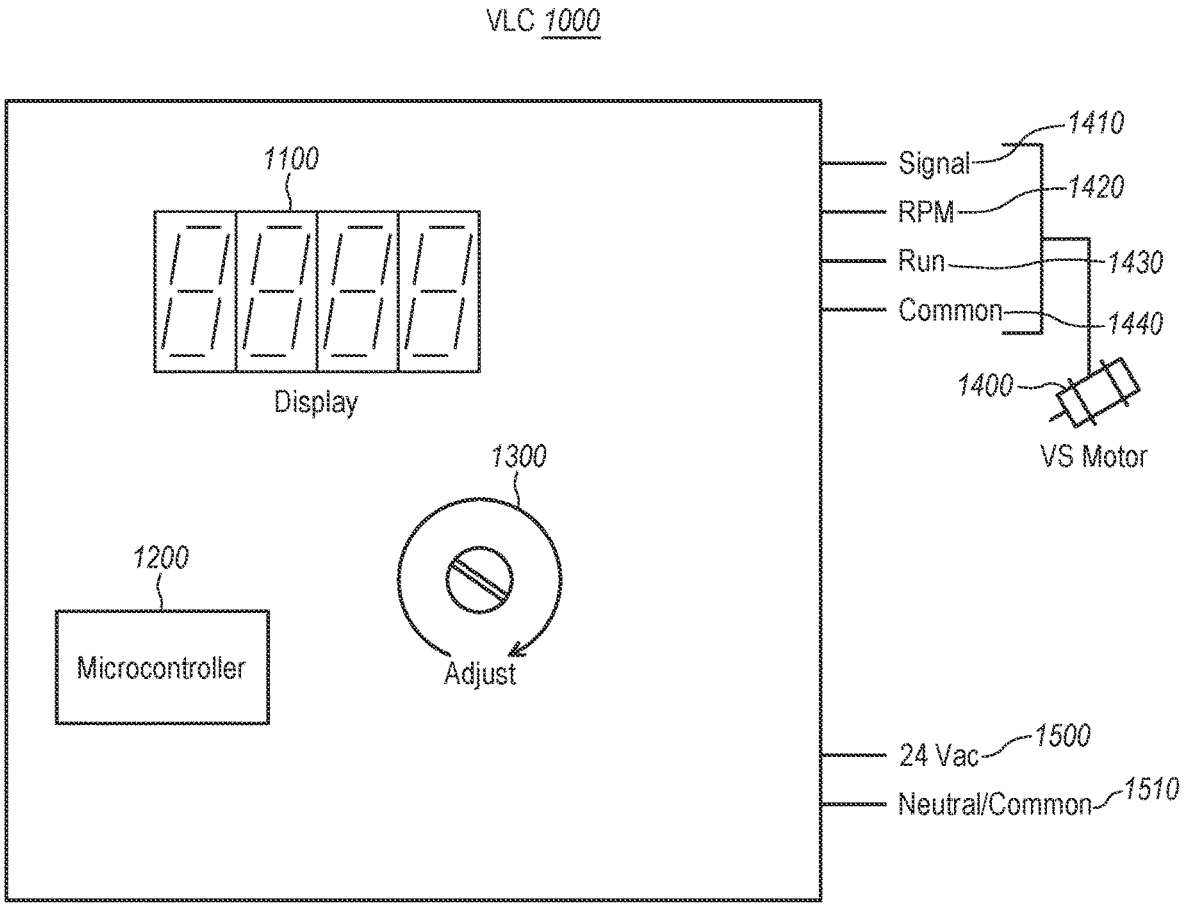
FIG. 1 (PRIOR ART)
FIG. 1 illustrates an example embodiment of a diagram of a prior art VLC.

FIG. 1 illustrates an example embodiment of a diagram of prior art VLC 1000. VLC 1000 comprises a display 1100 to display the RPMs of a motor and a percentage of signal output of a motor, such as VS Motor 1400 or other controlled device, a microcontroller 1200 to control the motor and the display, a manually operated adjust mechanism 1300 to adjust the percent of signal output to the VS Motor 1400, a signal output 1410 connected to the variable speed VS Motor 1400 or other controlled device to set its speed, an RPM input 1420 to receive a tachometer signal from a connected VS Motor 1400 or other controlled device, a run output 1430 to cause a connected variable speed motor VS Motor 1400 or other device to turn on, a common 1440 to serve as an electrical return path for the connected VS Motor 1400 or other controlled device, a 24 Vac input 1500 to power the VLC and a 24 Vac neutral/common 1510 electrical return and safety ground for the 24 Vac 1500 power.

Scaling VLC Diagram 2000

Figure 2:
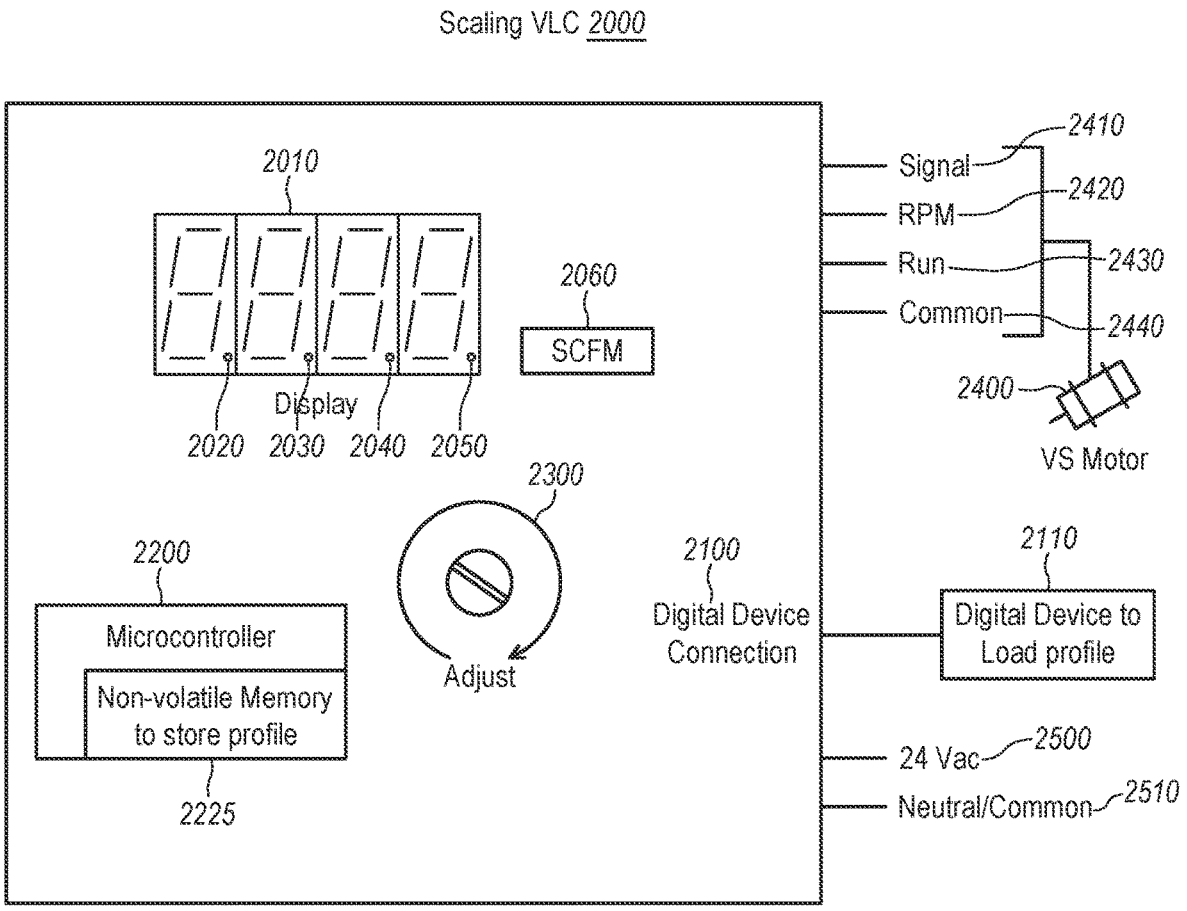
FIG. 2 illustrates an example embodiment of a diagram of the Scaling VLC of this invention.

FIG. 2 illustrates an example embodiment of a diagram of Scaling VLC 2000. In one embodiment, Scaling VLC 2000 comprises a display 2010, decimal points 2020, 2030, 2040 and 2050, microcontroller 2200, non-volatile memory 2225, a profile input 2100, a manually operated adjust 2300, a signal output 2410, an input 2420, a run output 2430, a common 2440, a power connection 2500, and a safety ground 2510 for the power connection 2500.

In various example embodiments, connected HVACR device 2400 can compromise a motor, a variable speed motor, an air valve, a water valve, a temperature controller, or other signal-controlled device. In various example embodiments, the display 2010 can display a display value in the terms of speed, revolutions per minute, torque, mass air flow, gallons per minute, rotary actuator angle, linear actuator stroke, pressure regulator pressure, or other engineering units as needed by the connected device. In one embodiment, decimal points 2020, 2030, 2040 and 2050 also facilitate the display value by display 2010.

Profile input 2100 is used to receive the VLC digital adjustment profile 3000 (FIG. 3) from an external digital device 2110 and provide it to non-volatile memory 2225. Non-volatile memory 2225 can be either integrated with the microcontroller 2200 or connected to the microcontroller 2200 within Scaling VLC 2000. Non-volatile memory 2225 stores the VLC digital adjustment profile 3000 for access by the microcontroller 2200. Microcontroller 2200 uses VLC digital adjustment profile process 5000 (FIG. 5) with digital adjustment profile 3000 to determine the display value to send to display 2010 for displaying and the output signal to send to HVACR device 2400. In one embodiment, manually operated adjust 2300 can also be used to manually adjust the output signal before it is provided to the HVACR device 2400.

Signal output 2410 is connected to the HVACR device 2400 to provide the output signal to the HVACR device 2400. Input 2420 receives an input signal from a connected HVACR device 2400, such as a signal from a tachometer for a motor. Run output 2430 is used to cause a connected HVACR device 2400 to turn on. Common 2440 serves as an electrical or signal return path for the connected HVACR device 2400. Power connection 2500 powers the Scaling VLC 2000. In one embodiment, power connection 2500 comprises a twenty-four-volt AC power connection.

In one embodiment, the desired display value when the output signal is at zero percent, the desired display value when the signal output is at one-hundred percent, and the position of the display decimal point, are defined in the VLC digital adjustment profile 3000 and then loaded into the non-volatile memory 2225 for the microcontroller 2200 to determine the output signal and display value. The display 2010 displays the display value in the range from zero percent to one-hundred percent. In one embodiment, a decimal point position may be defined in the VLC digital adjustment profile 3000 to place a decimal point between any digit in the display 2010. In another embodiment, the decimal point position may be calculated by microcontroller 2200 using floating point processing. With floating point processing, the decimal position is determined by a math package. Engineering units for the display value may be displayed by fixing a label or adding alpha numeric digits to display 2010. In other embodiments, other math calculations can be used to convert to the desired scaling. For example, the desired value for 0% and 100% could define any two points.

In another embodiment, the number of connected motor RPM pulses per a single turn of the connected HVACR device 2400 is output by the connected HVACR device 2400 to the Scaling VLC 2000 with input 2420 and displayed with display 2010.

In another embodiment, the minimum allowed output and maximum allowed output are defined in VLC digital adjustment profile 3000 and then loaded into the Scaling VLC 2000. The Scaling VLC 2000 outputs an output signal no lower than the minimum allowed output and no greater than the maximum allowed output.

VLC Digital Adjustment Profile 3000

FIG. 3 provides a table of the VLC digital adjustment profile 3000. VLC digital adjustment profile 3000 is a set of values that are loaded into a set of registers corresponding to a Min Display Value 3010, a Max Display Value 3020, a Decimal Position 3030, a Pulses per Turn 3040, a High Out Limit 3010, and a Low Out Limit 3060. The Min Display Value 3010 is the display value when the output signal equals zero percent (0%) of the maximum potential output value. The Max Display Value 3020 is the display value when the output signal equals one-hundred percent (100%) of the maximum potential output value. The Decimal Position 3030 is the number of the decimal positions or zero if there is no decimal point. Pulses Per Turn 3040 is the number of pulses per turn from the connected HVACR device 2400. High Out Limit 3050 is the maximum percent allowed from the output of the connected HVACR device 2400. Low Out Limit 3060 is the minimum percent allowed from the output of the connected HVACR device 2400.

VLC Adjustment Process 4000

FIG. 4 illustrates an example embodiment of VLC Adjustment Process 4000 for the prior art VLC 1000 as shown in FIG. 1 for a VS Motor 1400 or other controlled HVAC device.

At step 4010, the VLC adjustment profile process 4000 begins and moves to step 4020. At step 4020, the VLC adjustment profile process 4000 checks if manually operated adjust 1300 is being operated, or adjusted. If manually operated adjust 1300 is not being operated, the VLC adjustment profile process 4000 moves to step 4030 to display the RPM of the connected VS Motor 1400 or other controlled device. Then the VLC adjustment profile process 4000 moves to step 4010 to again begin the VLC adjustment profile process 4000. Returning to step 4020, if manually operated adjust 1300 is being operated, the VLC adjustment profile process 4000 moves to step 4040. At step 4040, the current setting for the manually operated adjust 1300 is read by microcontroller 1200 and converted to a value representing the percentage from zero-percent (0%) to one-hundred percent (100%) of the maximum potential output of the motor. Then the VLC adjustment profile process 4000 moves to step 4050 where the value from step 4040 is saved as a Motor Out (Mout) value and output to the VS Motor 1400 or other controlled device. The VLC adjustment profile process 4000 then moves to step 4060 where the Mout value is output to the display 1100. Then the VLC adjustment profile process 4000 moves back to step 4010 to again begin the VLC adjustment profile process 4000.

VLC Digital Adjustment Profile Process Flow 5000

Figure 5:
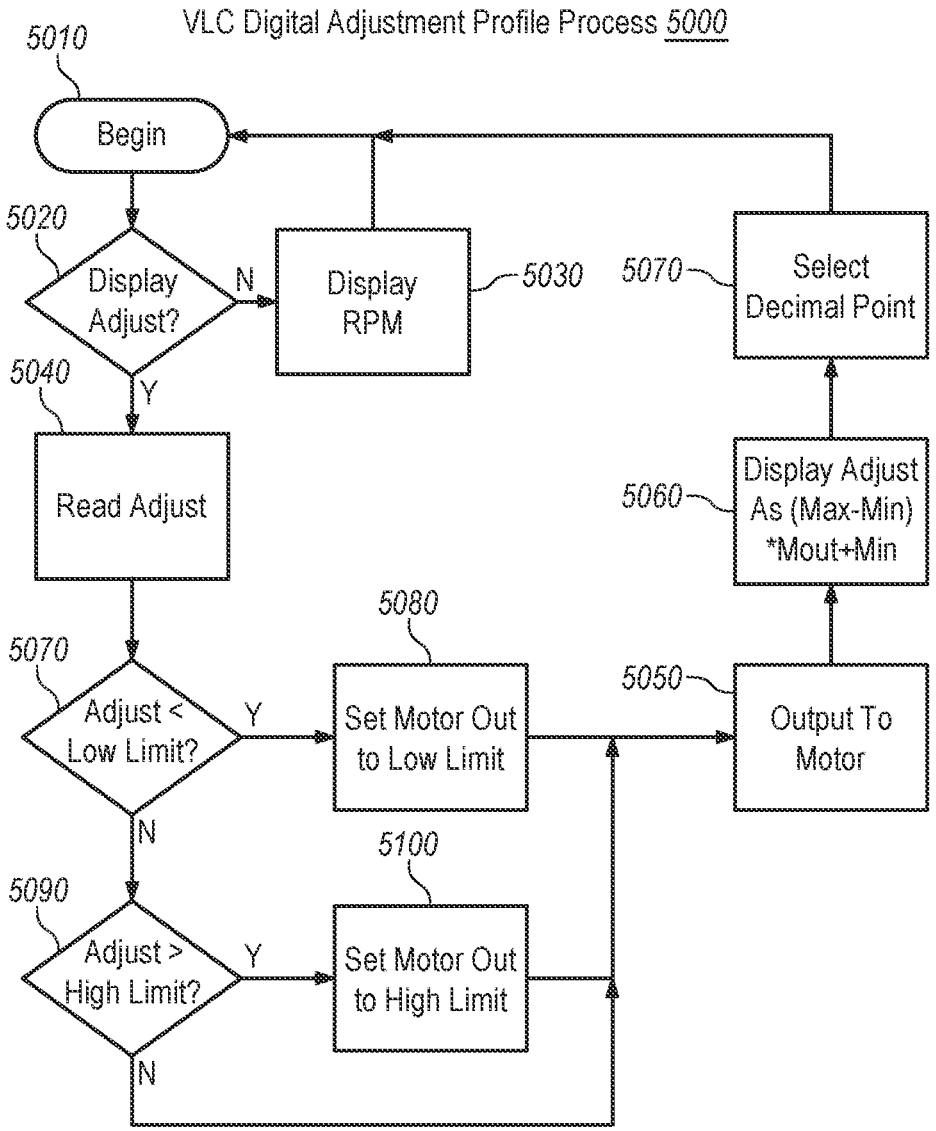
FIG. 5 illustrates a flow diagram for the Scaling VLC digital adjustment profile.

FIG. 5 illustrates an example embodiment of a flow diagram for VLC digital adjustment profile process 5000 using the VLC digital adjustment profile 3000 shown in FIG. 3 for Scaling VLC 2000 as shown in FIG. 2.

At step 5010 the VLC digital adjustment profile process 5000 begins. At step 5020, the VLC digital adjustment profile process 5000 checks if manually operated adjust 2300 is being operated, or adjusted. If manually operated adjust 2300 is not being operated, the VLC digital adjustment profile process 5000 moves to step 5030 to display the input value, such as the speed, revolutions per minute, torque, mass air flow, gallons per minute, rotary actuator angle, linear actuator stroke, pressure regulator pressure, or other engineering units of the connected HVACR device 2400 on the display 2010. The VLC digital adjustment profile process 5000 then moves to step 5010 to repeat the VLC digital adjustment profile process 5000.

Returning to step 5020, if manually operated adjust 2300 is being operated, the VLC digital adjustment profile process 5000 moves to step 5040. At step 5040, the value of the position of the manually operated adjust 2300 is read and converted to a value representing the percentage from zero-percent (0%) to one-hundred percent (100%) of the maximum potential output of the connected HVACR device 2400 and saved as Mout (output).

The VLC digital adjustment profile process 5000 then moves to step 5070 where the Mout value is compared to the Low Out Limit Value 3060. If Mout is less than Low Out Limit Value 3060, the VLC digital adjustment profile process 5000 moves to step 5080. At step 5080, the Low Out Limit Value 3060 is saved as Mout. The VLC digital adjustment profile process 5000 then moves to step 5050 where it outputs a signal representing Mout to the connected HVACR device 2400 to set the speed or other parameter.

Returning to step 5070, the Mout value is compared to the Low Out Limit Value 3060. If Mout is greater than the Low Out Limit Value 3060, the VLC digital adjustment profile process 5000 moves to step 5090 where Mout is compared to the High Out Limit Value 3050. If Mout is greater than the High Out Limit Value 3050, the VLC digital adjustment profile process 5000 moves to step 5100. At step 5100, the High Out Limit Value 3050 is saved as Mout. The VLC digital adjustment profile process 5000 then moves to step 5050 where it outputs a signal representing Mout to set the speed or other parameter of the connected HVACR device 2400.

Returning to step 5090, if manually operated adjust 2300 is less than the High Out Limit Value 3050, the VLC digital adjustment profile process 5000 moves to step 5050 where it outputs a signal representing Mout to set the speed or other parameter of the connected HVACR device 2400.

Continuing the VLC digital adjustment profile process 5000 from step 5050, Mout is mathematically adjusted to display a display value defined by the Min Display Value 3010 and Max Display Value 3020. The Min Display Value 3010 is subtracted from the Max Display Value 3020. The result is then multiplied by the output value Mout and then added to the Min Display Value 3010. The resulting display value to be displayed is sent to the display 2010. Next, the VLC digital adjustment profile process 5000 moves to step 5070 where the Decimal Position Register 3030 selects a decimal point 2020, 2030, 2040, 2050 or none to illuminate on the display 2010, and the selection is sent to the display 2010. Then, the VLC digital adjustment profile process 5000 moves again to step 5010 where the VLC digital adjustment profile process 5000 restarts.

The disclosed embodiments are illustrative, not restrictive. While specific configurations have been described, it is understood that the present invention can be applied to a wide variety of applications. There are many alternative ways to implement the invention.

What is claimed is:

1. A visual local controller for heating, ventilating, air-conditioning, and refrigeration systems comprising:

a power connection;

a signal output connected to a controlled heating, ventilating, air-conditioning, and refrigeration device for providing an output signal to the controlled heating, ventilating, air-conditioning, and refrigeration device;

a display unit to display a display value;

a profile input for receiving a digital adjustment profile, the digital adjustment profile comprises a plurality of values for use in adjusting the output signal for the controlled heating, ventilating, air-conditioning, and refrigeration device;

the plurality of values of the digital adjustment profile comprises:

a minimum display value of the display of the visual local controller;

a maximum display value of the display of the visual local controller;

a minimum output value of the visual local controller; and a maximum output value of the visual local controller;

a non-volatile memory for storing the digital adjustment profile;

a microcontroller connected to the non-volatile memory;

a manually operated adjust for adjusting the output signal;

wherein the microcontroller obtains from the digital adjustment profile stored in the non-volatile memory the minimum output value of the visual local controller and the maximum output value of the visual local controller;

wherein the microcontroller obtains a current output from the manually operated adjust that corresponds to the manually operated adjust;

wherein the microcontroller obtains from the digital adjustment profile stored in the non-volatile memory the minimum display value of the visual local controller and the maximum display value of the visual local controller;

wherein the microcontroller uses the minimum output value of the visual local controller, the maximum output value of the visual local controller, and the current output to determine the output signal to supply to the controlled heating, ventilating, air-conditioning, and refrigeration device; and wherein the microcontroller uses the digital adjustment profile to determine the display value displayed on the display unit between the minimum display value of the visual local controller and the maximum display value of the visual local controller.

2. The visual local controller of claim 1 further comprising an input to receive an input signal from the controlled heating, ventilating, air-conditioning, and refrigeration device.

3. The visual local controller of claim 2 wherein the display unit displays information in response to the input signal received at the input.

4. The visual local controller of claim 2 wherein the input signal comprises a signal from a tachometer expressed as pulses per second.

5. The visual local controller of claim 4 wherein one of the plurality of values of the digital adjustment profile comprises a pulses per second value substantially equal to the pulses per second value from the input signal.

6. The visual local controller of claim 1 further comprising a run output to turn on the controlled heating, ventilating, air-conditioning, and refrigeration device.

7. The visual local controller of claim 1 wherein the display unit further displays a decimal point.

8. The visual local controller of claim 1 wherein the display unit further displays engineering units.

9. The visual local controller of claim 8 wherein the display unit further displays a decimal point.

10. The visual local controller of claim 1 wherein the display value comprises a number of revolutions per minute of the controlled heating, ventilating, air-conditioning, and refrigeration device.

11. The visual local controller of claim 1 wherein the display value comprises a torque value of the controlled heating, ventilating, air-conditioning, and refrigeration device.

12. The visual local controller of claim 1 wherein the display value comprises a control voltage value of the controlled heating, ventilating, air-conditioning, and refrigeration device.

13. The visual local controller of claim 1 wherein the display value comprises a mass airflow value of the controlled heating, ventilating, air-conditioning, and refrigeration device.

14. The visual local controller of claim 1 wherein the display value comprises a gallons per minute value of the controlled heating, ventilating, air-conditioning, and refrigeration device.

15. The visual local controller of claim 1 wherein the display value comprises a damper degree angle of the controlled heating, ventilating, air-conditioning, and refrigeration device.

16. The visual local controller of claim 1 wherein the non-volatile memory is integrated with the microcontroller on the same integrated circuit.

17. The visual local controller of claim 1 wherein the controlled heating, ventilating, air-conditioning, and refrigeration device comprises a motor.

18. The visual local controller of claim 17 wherein the motor comprises a variable speed motor.

19. The visual local controller of claim 1 wherein the power connection comprises a 24 Volt power connection.

20. The visual local controller of claim 1 wherein the controlled heating, ventilating, air-conditioning, and refrigeration device comprises an air valve.

21. The visual local controller of claim 1 wherein the controlled heating, ventilating, air-conditioning, and refrigeration device comprises a water valve.

22. The visual local controller of claim 1 wherein the controlled heating, ventilating, air-conditioning, and refrigeration device comprises a temperature controller.

23. The visual local controller of claim 1 wherein the controlled heating, ventilating, air-conditioning, and refrigeration device comprises a linear actuator.

24. The visual local controller of claim 1 wherein the controlled heating, ventilating, air-conditioning, and refrigeration device comprises a pressure regulator.

25. The visual local controller of claim 1 wherein the minimum display value of the display of the visual local controller correlates with the minimum output value of the visual local controller.

26. The visual local controller of claim 1 wherein the maximum display value of the display of the visual local controller correlates with the maximum output value of the visual local controller.

27. The visual local controller of claim 1 wherein the plurality of values of the digital adjustment profile correspond to points on a calibration curve.

28. A visual local controller for heating, ventilating, air-conditioning, and refrigeration systems comprising:

a power connection;

a signal output connected to a controlled heating, ventilating, air-conditioning, and refrigeration device for providing an output signal to the controlled heating, ventilating, air-conditioning, and refrigeration device;

a display unit to display a display value;

an input to receive an input signal from the controlled heating, ventilating, air-conditioning, and refrigeration device;

a run output to turn on the controlled heating, ventilating, air-conditioning, and refrigeration device;

a signal return path;

a profile input for receiving a digital adjustment profile, wherein the digital adjustment profile comprises a plurality of values for use in adjusting the output signal for the controlled heating, ventilating, air-conditioning, and refrigeration device;

the digital adjustment profile comprises:

a minimum display value of the display of the visual local controller;

a maximum display value of the display of the visual local controller;

a minimum output value of the visual local controller; and a maximum output value of the visual local controller;

a non-volatile memory for storing the digital adjustment profile;

a microcontroller connected to the non-volatile memory;

a manually operated adjust for adjusting the output signal;

wherein the microcontroller obtains from the digital adjustment profile stored in the non-volatile memory the minimum output value of the visual local controller and the maximum output value of the visual local controller;

wherein the microcontroller obtains a current output from the manually operated adjust that corresponds to the manually operated adjust;

wherein the microcontroller obtains from the digital adjustment profile stored in the non-volatile memory the minimum display value of the visual local controller and the maximum display value of the visual local controller;

wherein the microcontroller uses the minimum output value of the visual local controller, the maximum output value of the visual local controller, and the current output to determine the output signal to supply to the controlled heating, ventilating, air-conditioning, and refrigeration device; and wherein the microcontroller uses the digital adjustment profile to determine the display value displayed on the display unit between the minimum display value of the visual local controller and the maximum display value of the visual local controller.

29. The visual local controller of claim 28 wherein the display unit displays information in response to the input signal received at the input.

30. The visual local controller of claim 28 wherein the controlled heating, ventilating, air-conditioning, and refrigeration device comprises a motor.

31. The visual local controller of claim 30 wherein the motor comprises a variable speed motor.

32. The visual local controller of claim 31 wherein the input signal comprises a signal from a tachometer expressed as pulses per second.

33. The visual local controller of claim 32 wherein one of the plurality of values of the digital adjustment profile comprises a pulses per second value substantially equal to the pulses per second value from the input signal.

34. The visual local controller of claim 28 wherein the minimum display value of the display of the visual local controller correlates with the minimum output value of the visual local controller.

35. The visual local controller of claim 28 wherein the maximum display value of the display of the visual local controller correlates with the maximum output value of the visual local controller.

36. The visual local controller of claim 28 wherein the plurality of values of the digital adjustment profile correspond to points on a calibration curve.

37. The visual local controller of claim 28 wherein the display unit further displays a decimal point.

38. The visual local controller of claim 28 wherein the display unit further displays engineering units.

39. The visual local controller of claim 38 wherein the display unit further displays a decimal point.

* * * * *